United States Patent [19]

Weick

[11] 4,058,972

[45] Nov. 22, 1977

[54] WRISTWATCH HAVING A PERFUME CHAMBER

[76] Inventor: Heinz Hermann Weick, 94, rue de la Servette, 1202 Genf, Switzerland

[21] Appl. No.: 651,244

[22] Filed: Jan. 22, 1976

[30] Foreign Application Priority Data

| | | |
|---|---|---|
| Jan. 24, 1975 | Switzerland | 964/75 |
| Mar. 10, 1975 | Switzerland | 3037/75 |

[51] Int. Cl.[2] ..... A45C 11/10; G04B 37/12

[52] U.S. Cl. ..... 58/88 E; 58/152 R; 224/4 A; 224/4 E; 224/28 W

[58] Field of Search ..... 58/53, 88 R, 88 E, 152 R; D10/2, 31; 224/4 A, 4 D, 4 E, 4 F, 28 W

[56] References Cited

U.S. PATENT DOCUMENTS

| | | | |
|---|---|---|---|
| 1,207,296 | 12/1916 | Kastor | 58/88 R |
| 2,182,194 | 12/1939 | Blau | 58/88 E |
| 2,853,182 | 9/1958 | Barnett | 58/152 R X |
| 2,948,106 | 8/1960 | Blumstein | 58/152 R UX |

FOREIGN PATENT DOCUMENTS

| | | |
|---|---|---|
| 282,883 | 9/1952 | Switzerland |
| 341,447 | 11/1959 | Switzerland |

*Primary Examiner*—Stanley J. Witkowski
*Attorney, Agent, or Firm*—Fleit & Jacobson

[57] ABSTRACT

A wrist watch casing has a perfume chamber which opens to the exterior at a rearwardly-disposed surface of the casing, that is, nearer to the wearer's wrist than to the watch face surface.

7 Claims, 3 Drawing Figures

WRISTWATCH HAVING A PERFUME CHAMBER

BACKGROUND OF THE INVENTION

The present invention relates to a wrist watch casing and to a watch having such a casing. The casing of the watch has at least one chamber which may enclose an absorbent medium to accommodate perfume, the chamber being open to the outside via at least one evaporation orifice.

With such a casing, it is possible to achieve a relatively even long-term evaporation of the perfume.

DISCUSSION OF THE PRIOR ART

Wrist watches of the above general type have been disclosed in the prior published literature. Where these watches are concerned, a perfume chamber of annular construction and enclosed all round is situated above the watch mechanism and, starting from a rear supporting surface, is integrally formed on an upper part of the casing which encircles the watch glass like a frame. The evaporation area is formed by a plurality of small upwardly directed orifices which surround the watch glass.

Disposed in this way, the perfume chamber requires a complicated construction of casing. Also, the visible evaporation orifices have a considerable effect on the appearance of the watch and do not suit every taste.

Relatively large visible evaporation orifices are aesthetically completely impossible. On the other hand, if they are small and thus more discreet, their evaporation effect is inadequate. Furthermore, the said orifices tend to collect dirt. Filling the chamber with perfume presents great difficulty unless a special, i.e. relatively large opening is provided for the purpose, but this again has an unattractive visual effect.

The absorbent means within the perfume chamber, constructed for example as a felt strip, can only be exchanged by a specialist who is required to dismantle the corresponding part of the casing. This disadvantage is particularly significant, since the felt or the like becomes in course of time steeped with non-evaporated oily perfume residues. It therefore gradually loses its absorption and has to be replaced by a fresh strip.

OBJECT OF THE INVENTION

The present invention aims to avoid or at least greatly reduce all the said disadvantages by providing a novel disposition of perfume chamber.

SUMMARY OF THE INVENTION

The invention resides in the fact that the perfume chamber is formed on the casing, starting from an outer portion of the casing surface which is situated lower down than the upper part of the outer surface of the casing which frames the watch glass, the perfume chamber having at least one evaporation orifice which is situated lower down, that is, nearer to the wrist of the wearer than to the watch face surface of the casing, than the aforesaid upper outer surface of the casing.

In the case of such a chamber disposition, its orifice or orifices will be substantially to completely concealed when the watch is being worn. The slot-shaped chamber can therefore remain outwardly open over its entire length and width. The result is a large and effective evaporation area. Moreover, exchanging the felt strip which can be self-adhesively maintained in the chamber is very simply and easily done by an unskilled person.

PREFERRED FEATURES OF THE INVENTION

If the slot-shaped chamber is formed from the bottom of the casing, which is the simplest procedure with injection moulding techniques, then the corresponding part of the surface of the bottom which contains the chamber orifice should be set back with respect to the plane of the casing bottom. By virtue of this measure, the chamber orifice does not lie directly on the arm, enabling air to flow past the orifice.

It is quite particularly advantageous if the narrow chamber has at least a part of its length extending over the portion of the casing which, on the mechanism side, is disposed in front of a watch-strap connector. By reason of the curvature of the arm, the casing has a certain bottom clearance in the vicinity of the connection points, enhancing the evaporation effect. Furthermore, the chamber can be additionally entirely or at least substantially invisibly and therefore very widely opened, i.e. towards the corresponding axis of attachment of the wrist strap. Bottom aperture and lateral aperture jointly produce a maximum large evaporation area in each wrist strap connection zone.

BRIEF DESCRIPTION OF THE DRAWINGS

An example of embodiment of the invention is shown in the attached drawings, in which.

DETAILED DESCRIPTION OF THE INVENTION

Figure 2:
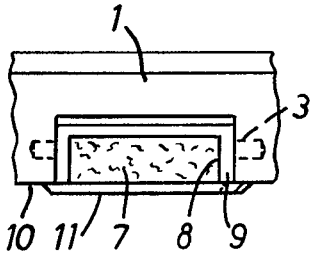
FIG. 2 is a side view of a wrist strap connection zone.
Figure 3:
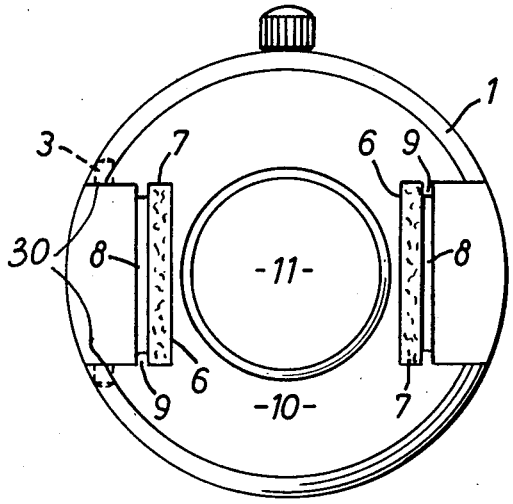
FIG. 3 is a view corresponding to FIG. 1, seen from below.

The wrist strap 4 (see FIG. 1) is attached to the main body of watch casing 1 at respective connection zones by means of spindles or strap securing pins 2 which engage into bores 3. Spindles 2 and bores 3 define strap connection means, and reside in connection zones 20. Between these points of attachment and the cylindrical space 5 for the mechanism, not shown, are disposed the two slot-shaped perfume chambers 6 which are integrally formed on the bottom and which are therefore open at the rear, being filled with an absorbent material in the form of felt strips 7. The perfume chambers may be formed by a moulding or forming tool applied to the rear surface of the casing. The chambers 6 extend into the interior of casing 1 from an outer portion thereof, and are also very widely open laterally, i.e. towards the wrist strap connection points, in that in the aforesaid direction they are bounded only by a web 9 surrounding the lateral openings 8, the web 9 serving for lateral retention of the clamped-in felt strip 7. As can be seen in FIGS. 2 and 3, each perfume chamber 6 extends longitudinally so that at least a major portion of its length is adjacent a connection zone 20.

Figure 1:
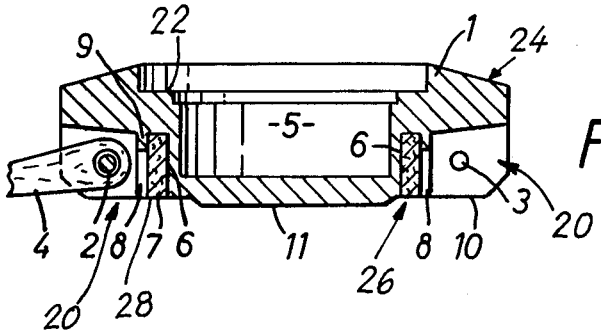
FIG. 1 is a cross-section in the longitudinal direction of the wrist strap, through a wrist watch casing provided with two perfume chambers situated adjacent to the wrist strap connection zones.

FIG. 1 also shows, in particular, that a circular portion 10 of the bottom, comprising the chambers 6, is set back with respect to the rear surface, or central, generally flat portion 11 of the bottom, which forms the surface which rests against the arm. A watch glass is adapted to lie in a recess 22 defined in a front surface 24 of casing 1, and bounded by opposed end walls 30. As can best be seen in FIGS. 1 and 3, central portion 11 extends beyond the surface of a surrounding portion 26, which surrounding portion contains the rearward outer boundry 28 of the perfume chambers 6.

This chamber arrangement combines a maximum of advantages. The chambers 6 and their large evaporation orifices are completely concealed. The felt strips 7 can be exchanged in an extremely simple fashion. The stage-like construction of the casing bottom increases the bottom clearance which already exists in the wrist strap connecting points, so that the chamber orifices or openings 8 in the bottom can be fully utilized for evaporation. The position of the chambers 6 with respect to the wrist strap connection points also allows a discreet positioning of the lateral evaporation orifices or openings 8. The chambers are integrally moulded in the mould stripping direction of the injection moulding process, i.e. without the use of any tools such as side pushers or the like and therefore entail no financial outlay of any kind.

It goes without saying that the example of embodiment is only one (though particularly advantageous) manner of implementing the forms and dispositions of the perfume chamber which are possible according to the invention.

I claim:

1. A wrist watch comprising: a main body portion having a front surface for associating with a watch glass and a rear surface for associating with the wrist of a wearer; at least two connection zones on said main body portion, and including strap connection means whereby a wrist strap can be connected thereto, each said connection zone defining a recess within which said strap connection means is disposed; a perfume chamber extending into the main body portion from an outer portion thereof, said outer portion being situated more rearwardly than said front surface; and at least one evaporation orifice or aperture defined by the walls of said perfume chamber, adjacent one of said connection zones and opening at said rear surface.

2. A wrist watch casing according to claim 1, wherein the perfume chamber extends longitudinally and has at least a major part of its length adjacent said one of said connection zones, on the side thereof remote from said strap connection means.

3. A wrist watch casing according to claim 1, wherein the said rear surface has a central generally flat portion and a surrounding portion, the central portion extending beyond the surrounding portion and adapted to engage the wrist of a wearer; wherein the surrounding portion constitutes the said outer portion; and wherein said surrounding portion is generally flat and contains the rearward outer boundary of at least one perfume chamber extending inwardly from said boundary.

4. A wrist watch casing comprising: a main body portion having a front surface for associating with a watch glass and a rear surface for associating with the wrist of a wearer; at least two connection zones on said main body portion, and including strap connection means whereby a wrist strap can be connected thereto, each said connection zone having a wall which defines a recess within which said strap connection means is disposed; a perfume chamber defined by walls which extend into the main body portion from an outer portion thereof, said outer portion being situated more rearwardly than said front surface; and at least one evaporation orifice or aperture defined by the walls of said perfume chamber adjacent one of said connection zones opening directly into said recess thereof.

5. A wrist watch casing according to claim 4, wherein there are two connection zones, each constituted by a recess, one at each side of the casing, and including opposed end walls; wherein each of the end walls of each recess contains a bore for the reception of a strap-securing pin; and wherein each recess is separated from the perfume chamber by a web.

6. A wrist watch casing according to claim 4, wherein the said rear surface has a central generally flat portion and a surrounding portion, the central portion extending beyond the surrounding portion and adapted to engage the wrist of a wearer; wherein the surrounding portion constitutes the said outer portion; and wherein said surrounding portion is generally flat and contains the rearward outer boundry of at least one perfume chamber extending inwardly from said boundary.

7. A wrist watch casing according to claim 4, wherein there are two connection zones, each constituted by a respective recess, one at each side of the casing, and including opposed end walls; wherein each of the end walls of each recess contains a bore for the reception of a strap-securing pin; and wherein each recess is separated from the perfume chamber by a web whose height is less than the height of the recess.

* * * * *